United States Patent [19]

Ruscher

[11] 4,153,154

[45] May 8, 1979

[54] JEWELRY DISPLAY CASE

[76] Inventor: Fredric C. Ruscher, 6113 W. Marlette, Glendale, Ariz. 85301

[21] Appl. No.: 910,211

[22] Filed: May 30, 1978

[51] Int. Cl.[2] ..... B65D 11/10; B65D 5/50

[52] U.S. Cl. ..... 206/45.19; 206/566

[58] Field of Search ..... 206/45.31, 45.34, 45.19, 206/566, 523, 591, 594; 220/82 R, 82 A, 306

[56] References Cited

U.S. PATENT DOCUMENTS

| | | | |
|---|---|---|---|
| 2,921,673 | 1/1960 | Ryan | 206/45.31 |
| 2,944,663 | 7/1960 | Kaspari et al. | 206/45.19 |
| 3,409,062 | 11/1968 | Vilanova | 206/45.34 |
| 3,530,978 | 9/1970 | Lewandowski | 206/45.34 |
| 3,744,663 | 7/1973 | Moren | 206/45.34 |
| 4,016,972 | 8/1977 | Szamborski | 206/45.34 |

FOREIGN PATENT DOCUMENTS

| | | | |
|---|---|---|---|
| 195493 | 4/1923 | United Kingdom | 206/566 |

*Primary Examiner*—Herbert F. Ross
*Attorney, Agent, or Firm*—Martin L. Stoneman

[57] ABSTRACT

A generally-rectangular small portable display case for displaying jewelry and the like including a bottom container having therein a resilient display member for holding the items to be displayed; an upper lid having opposed sides which are outwardly elastically deformable and having a viewing hole in the top of the lid; and a transparent retaining member therebeneath and connected thereto by connection means including a pair of opposed latch members for detachably connecting the lid to the bottom container. The bottom container includes a peripheral lip supported from beneath by the latch members when the display case is closed.

7 Claims, 4 Drawing Figures

JEWELRY DISPLAY CASE

BACKGROUND OF THE INVENTION

This invention relates to display cases. More particularly, the invention concerns a small portable display case for displaying jewelry and the like.

In a further aspect, the invention concerns a portable display case of the type comprising a generally-rectangular bottom container having a matching lid with a viewing hole therein.

It has been a problem in the past for jewelry salesmen and the like to transport and show their products not only with safety from loss, but also in a manner adapted to most beneficially and beautifully display the merchandise to a prospective customer. Furthermore, because of the value of the items in the display case, it has been the prior practice that such display cases include positive closure means, and such closure means have been of the type which not only increase the expense of the case, but are a constant source of inconvenience and irritation to the display case user when such user desires to open and close the case. Such closure means, for example, have included easily-lost pin members, etc. Also, because of the necessity for maintaining the integrity of the basic box protecting and displaying the jewelry along with positive closure means, the range of materials and construction commonly used in the prior art has necessitated inefficiency of manufacture and resulting inordinate expense.

It would be highly advantageous, therefore, to provide a portable display case for jewelry and the like which is not only adapted to well serve the user in terms of display case integrity and optimal promotional display characteristics, but provides also for the solution of the other problems hereinbefore mentioned with respect to the prior art.

SUMMARY OF THE INVENTION

Accordingly, it is the primary object of the present invention to provide an improved jewelry display case.

Another object of the present invention is the provision of a portable display case adapted to serve the user in appropriate manners as hereinbefore mentioned in discussing the prior art.

Still another object is to provide a portable display case which is economically inexpensive.

Yet another object of the present invention is the provision of a display case of the above type which is convenient for the user to open and close.

Even another object is to provide a portable display case which allows the display of goods to be optimally visually effective while maintaining the safety requirements of such display.

Yet still another object of the present invention is the provision of a display case of the above type which is convenient and efficient in its manner of operation, relatively inexpensive and efficient to manufacture, and having a high degree of durability and serviceability.

Briefly, to accomplish the desired objectives of the present invention in accordance with the presently preferred embodiment thereof, there is provided a portable display case for displaying jewelry and the like having a generally-rectangular bottom container member and a corresponding generally-rectangular upper lid member having a viewing hole therein. A transparent retaining member is supported directly beneath and adjacent the lid member and a resilient display member for holding the items to be displayed is situated between the container member and the retaining member. The connection means for supporting the retaining member directly adjacent to the lid member includes mechanical means for attaching and detaching the container member from the lid member. Such mechanical means includes an inwardly-extending latch member. Further, the container member includes a peripheral lip member constructed and arranged to be supported from beneath by the latch member when the container member is in an attached juxtaposition with the lid member. The lid member includes a vertically-disposed side member having a central portion which is outwardly elastically deformable. And the connection means includes a pair of unitary longitudinal members disposed inwardly and oppositely adjacent the lid member, each longitudinal member including a horizontal surface and a vertical surface, the horizontal surface being permanently affixed to the retaining member and the vertical surface being permanently affixed to the lid member, and said longitudinal members further including a pair of inwardly-extending latch members whereby the peripheral lip member is supported from beneath by the pair of latch members when the container member is in an attached juxtaposition with the lid member.

BRIEF DESCRIPTION OF THE DRAWINGS

Further and more specific objects and advantages of the present invention will become readily apparent to those skilled in the art from the following detailed description thereof taken in connection with the drawings, in which.

DETAILED DESCRIPTION OF THE PREFERRED EMBODIMENT

Figure 1:
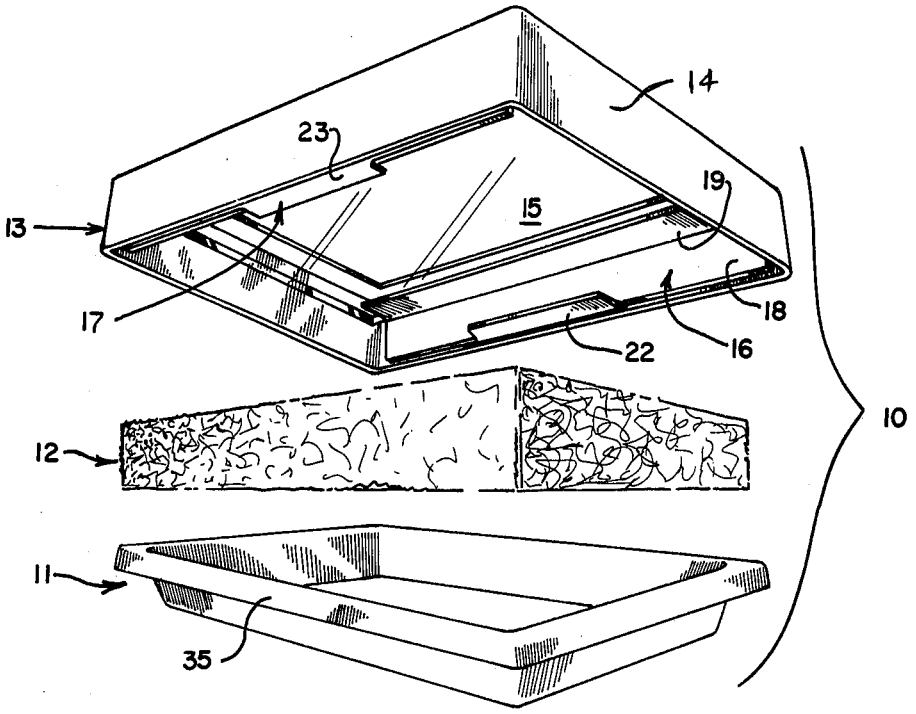
FIG. 1 is an artistic view in perspective of the preferred embodiment of the jewelry display case of the present invention, shown with parts in a vertically separated position.
Figure 2:
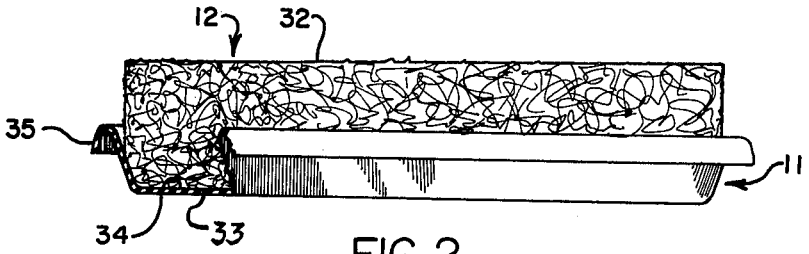
FIG. 2 is a front view of the illustrated preferred embodiment of the lower two members of FIG. 1, partially broken away.
Figure 3:
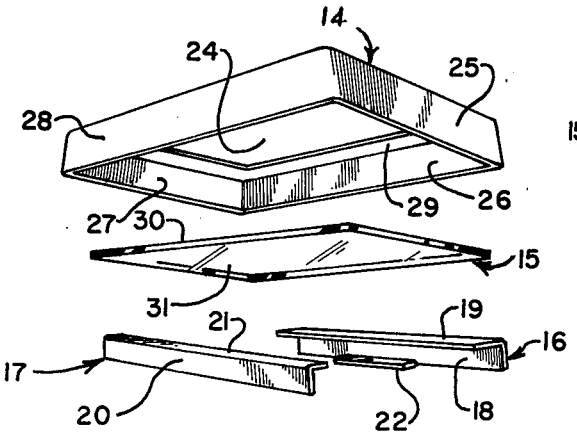
FIG. 3 is an artistic view in perspective of the illustrated preferred embodiment of the upper member of FIG. 1, with parts exploded.

Turning now to the drawings, in which the reference numerals indicate corresponding elements throughout the several views, FIGS. 1, 2, 3 and 4 illustrate the construction of the presently preferred display case assembly 10. With particular reference to FIG. 1, the display case assembly 10 includes a bottom container 11, a resilient pad 12, and a lid assembly 13. With particular reference to FIGS. 1 and 3, the lid assembly 13 includes lid member 14, transparent member 15, and connectors 16 and 17. Connectors 16 and 17 are a pair of unitary longitudinal members disposed inwardly and oppositely adjacent lid member 14.

Connector 16 includes a vertical portion 18 and a horizontal portion 19. Similarly, connector 17 includes a vertical portion 20 and a horizontal portion 21. Connector 16 further includes latch portion 22, which extends inwardly as shown. A similar latch portion 23 is included in connector 17.

Lid member 14 includes, centrally located in the upper portion thereof, a viewing hole 24, as illustrated.

The lid further includes four generally-vertical sides shown as vertical potions 25, 26, 27, and 28. Lid member 14 further includes underside portion 29.

As most particularly illustrated by FIG. 3, transparent member 15 is generally flat and horizontally situated and includes an upper surface 30 and a lower surface 31. Similarly, resilient pad 12 is generally flat and horizontally disposed and includes an upper surface 32 and a lower surface 33.

As most particularly illustrated by FIGS. 1 and 2, bottom container 11 is generally pan-shaped and its bottom includes generally-flat upper surface 34. Bottom container 11 further includes peripheral lip member 35 generally shaped in the manneer best illustrated in FIGS. 2 and 4.

The illustrated preferred embodiment of the display case assembly 10 of the present invention is most readily and preferably assembled as follows.

The lid assembly 13 is assembled by placing transparent member 15 within lid member 14 so that the upper surface 30 of transparent member 15 is pressed against the underside portion 29 of lid member 14. Next, the longitudinal connectors 16 and 17 are placed inside and adjacent lid member 14 in opposed and parallel relationship as illustrated. Longitudinal connectors 16 and 17 are then affixed, as with adhesives, as follows. Horizontal portion 19 of connector 16 is affixed to the lower surface 31 of transparent member 15 and vertical portion 18 of connector 16 is affixed to the inside of vertical portion 26 of lid member 14. Similarly, horizontal portion 21 of connector 17 is affixed to lower surface 31 of transparent member 15 and vertical portion 20 of connector 17 is affixed to the inside of vertical portion 28 of lid member 14. There results lid assembly 13 as best illustrated in FIG. 1.

Resilient pad 12 is placed within bottom container 11, as best illustrated in FIG. 2, so that the lower surface 33 of resilient pad 12 is resting upon the upper surface 34 of the bottom of bottom container 11. The goods to be displayed are placed in a desired manner on upper surface 32 of resilient pad 12.

Figure 4:
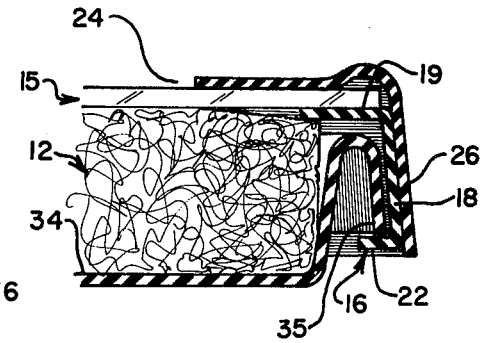
FIG. 4 is a partial sectional view of the latch portion of the present invention more specifically illustrating the details of the latch construction and operation.

The attaching and detaching of lid assembly 13 and bottom container 11 will now be described with reference to the drawings, most particularly FIG. 4. Lid assembly 13 is lowered in position around the outside of resilient pad 12 and bottom container 11. As lid assembly 13 is lowered, it is seen that latch portions 22 and 23 slide along the outside of peripheral lip 35 until latch portions 22 and 23 reach the bottom of peripheral lip 35. The generally-vertical portions 26 and 28 of lid member 14 are outwardly elastically deformable at the generally-central locations adjacent latch portions 22 and 23, thus permitting the described sliding movement of said latch portions around peripheral lip 35. As latch portions 22 and 23 reach the bottom of peripheral lip 35, however, said latch portions 22 and 23 are no longer supported outwardly by peripheral lip 35 and it is seen that they then elastically "snap" into the location illustrated by FIG. 4 to provide a positive closure of lid assembly 13 and bottom container 11. Thus, the goods to be displayed, located along the upper surface 32 of resilient pad 12, may be safely viewed (although retained) through viewing hole 24 and transparent member 15.

Presently preferred materials for use in the preferred embodiment of the present invention include a clear plate of glass for the material of transparent member 15. Resilient pad 12 may be composed of a white Dacron fibrous pad. The other illustrated elements of the present invention may be composed of a high-impact styrene plastic material. In the specific design and molding of the plastic material, the requisite dimensions to produce the result of the present invention will be clear to those skilled in the art, as will the dimensional and design requirements requisite in the manufacture of lid member 14 to ensure adequate elastic deformation, as described, of the generally vertical portions 26 and 28 of lid member 14.

Lid assembly 13 may be simply and easily detached from bottom container 11 merely by moving latch portions 22 and 23 in an outward direction, as with the fingers, until the latch portions are clear of peripheral lip 35, thus allowing the described separation of parts, as for the purpose of adding to or removing the jewelry or other goods displayed. It is also clearly seen that the resilient nature of resilient pad 12 permits the closure of the display case assembly 10 of the present invention without injury or destruction to the goods displayed.

It is seen that the jewelry display case of the present invention may be manufactured and utilized in a multiplicity of sizes, using the same as taught herein. Even an inexperienced user may open and close the jewelry display case of the present invention with ease. It is now further seen that the efficient and compact jewelry display case of the present invention is simple and economical in construction and design and yet easily adaptable to its mentioned needs and uses.

Various changes in the device herein shown for the purpose of illustration will readily occur to persons skilled in the art. Such modifications and variations, while not specifically denoted in the foregoing detailed description of the preferred embodiment, do not deviate from the teachings of the present invention and are intended to be included in the spirit and scope thereof, and the scope of the present invention is intended to be limited only by a fair interpretation of the following claims:

I claim:

1. A small, portable display case, for displaying jewelry and the like, comprising:
   a. a generally-rectangular bottom container member;
   b. a generally-rectangular upper lid member having a viewing hole therein;
   c. a transparent retaining member directly beneath said lid member;
   d. a resilient display member, for holding items to be displayed, between said retaining member and said container member; and
   e. a connection means for supporting said retaining member directly adjacent said lid member;
   f. said connection means including mechanical means for attaching and detaching said container member from said lid member.

2. The display case of claim 1 wherein said mechanical means includes an inwardly-extending latch member.

3. The display case of claim 2 wherein said container member includes a peripheral lip member constructed and arranged to be supported from beneath by said latch member when said container member is in an attached juxtaposition with said lid member.

4. The display case of claim 1 wherein said lid member includes a vertically-disposed side member having a central portion which is outwardly elastically deformable.

5. The display case of claim 4 wherein said connection means comprises a pair of unitary longitudinal members disposed inwardly and oppositely adjacent said lid member, each said longitudinal member including a horizontal surface and a vertical surface, said horizontal surface being permanently affixed to said retaining member, and said vertical surface being permanently affixed to said lid member.

6. The display case of claim 5 wherein said mechanical means includes a pair of inwardly-extending latch members.

7. The display case of claim 6 wherein said container member includes a peripheral lip member constructed and arranged to be supported from beneath by said pair of latch members when said container member is in an attached juxtaposition with said lid member.

* * * * *